US011661232B2

(12) United States Patent
Hengami

(10) Patent No.: US 11,661,232 B2
(45) **Date of Patent: *May 30, 2023**

(54) DUAL COMPARTMENT DISPENSING BOX WITH LATERAL SLIDE OPENINGS

(71) Applicant: David T. Hengami, Torrance, CA (US)

(72) Inventor: David T. Hengami, Torrance, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/505,996

(22) Filed: Oct. 20, 2021

(65) Prior Publication Data

US 2022/0041327 A1 Feb. 10, 2022

Related U.S. Application Data

(63) Continuation of application No. 16/576,729, filed on Sep. 19, 2019, now Pat. No. 11,180,281.

(60) Provisional application No. 62/733,557, filed on Sep. 19, 2018.

(51) Int. Cl.
*B65D 5/72* (2006.01)
*B65D 5/48* (2006.01)

(52) U.S. Cl.
CPC ..... *B65D 5/723* (2013.01); *B65D 5/48014* (2013.01)

(58) Field of Classification Search
CPC ..... B65D 5/48; B65D 85/60; B65D 5/48014; B65D 5/723
USPC ..... 229/129.1, 220, 120.18, 131.1, 122, 229/125.12, 121, 125.15, 120.03; 206/256; 222/561; 221/91
See application file for complete search history.

(56) References Cited

U.S. PATENT DOCUMENTS

| | | | |
|---|---|---|---|
| 958,707 | A | 1/1910 | Stafford |
| 1,543,953 | A | 6/1925 | Rothschild |
| 1,951,274 | A | 3/1934 | Denman |
| 2,000,210 | A | 5/1935 | Bayless |

(Continued)

FOREIGN PATENT DOCUMENTS

| | | |
|---|---|---|
| CN | 204399639 | 12/2014 |
| DE | 10044018 A1 | 9/2000 |

(Continued)

OTHER PUBLICATIONS https://issuu.com/designpackaging/docs/packaging-dielines-free-book-design—Packaging & Dielines: The Designer's Book of Packaging Dieline; published at least as early as Sep. 18, 2019; 2 pages.

(Continued)

*Primary Examiner* — Christopher R Demeree
(74) *Attorney, Agent, or Firm* — Concourse Law Group; Katherine B. Sales, Esq.

(57) ABSTRACT

A dual compartment box for dispensing two different pourable products, the box comprising a blank having an outer front panel, a back panel, an inner front panel having a first aperture and a second aperture, a separator panel, a top panel having a third aperture and a fourth aperture, and a first slide and a second slide positioned between the top panel and the inner front panel. The panels are foldably connected to form a box having a first compartment and a second compartment. The top panel overlays the first and second slides and the inner front panel such that the first aperture and the third aperture substantially align and the second aperture and the fourth aperture substantially align. The first slide is moveable laterally to form a first dispensing path, and the second slide is moveable laterally to form a second dispensing path.

11 Claims, 4 Drawing Sheets

(56) References Cited

U.S. PATENT DOCUMENTS

| | | | | |
|---|---|---|---|---|
| 2,330,926 | A | 10/1943 | Rous | |
| 2,342,081 | A | 2/1944 | Kirkland et al. | |
| 2,348,748 | A | 5/1944 | Otto | |
| 2,507,430 | A | 5/1950 | Yancey | |
| 2,857,881 | A | 10/1958 | Beebe | |
| 2,903,175 | A | 9/1959 | Peimer | |
| 2,950,851 | A | 8/1960 | Peimer | |
| 2,983,421 | A | 5/1961 | Turpin | |
| 3,009,565 | A | 11/1961 | Leone | |
| 3,016,178 | A | 1/1962 | Knocks | |
| 3,033,436 | A | 5/1962 | Peimer | |
| 3,040,953 | A | 6/1962 | Tindall | |
| 3,079,062 | A | 2/1963 | Craddock | |
| 3,082,929 | A | 3/1963 | Aquino et al. | |
| 3,115,290 | A | 12/1963 | Byassee | |
| 3,126,141 | A | 3/1964 | Walter | |
| 3,229,888 | A | 1/1966 | Gillam | |
| 3,438,482 | A | 4/1969 | Hamilton | |
| 3,441,125 | A | 4/1969 | Small | |
| 3,539,089 | A | 11/1970 | Osberg | |
| 3,610,510 | A | 10/1971 | Lowry | |
| 3,669,336 | A | 6/1972 | Robinson | |
| 3,819,093 | A | 6/1974 | Forbes | |
| 3,907,108 | A | 9/1975 | Weimer | |
| 4,054,203 | A | 10/1977 | Farquhar | |
| 4,063,679 | A | 12/1977 | Henry | |
| 4,081,128 | A | 3/1978 | O'Neill | |
| 4,094,456 | A | 6/1978 | Roccaforte | |
| 4,141,485 | A * | 2/1979 | Lambert | B65D 5/723 222/529 |
| 4,197,985 | A | 4/1980 | Austin | |
| 4,201,329 | A | 5/1980 | Roccaforte | |
| 4,274,578 | A | 6/1981 | Montealegre | |
| 4,349,105 | A | 9/1982 | Bradley et al. | |
| 4,361,270 | A * | 11/1982 | Roccaforte | B65D 5/723 229/120.03 |
| 4,438,848 | A | 3/1984 | Montealegre | |
| 4,452,355 | A | 6/1984 | Benham | |
| 4,609,142 | A | 9/1986 | Adamek | |
| 5,040,721 | A | 8/1991 | Essack | |
| D319,976 | S | 9/1991 | Wortley et al. | |
| D320,935 | S | 10/1991 | Nylander | |
| 5,056,708 | A * | 10/1991 | Boyle | B65D 5/48014 229/120.18 |
| 5,135,158 | A | 8/1992 | Boyle et al. | |
| 5,145,070 | A | 9/1992 | Pallett et al. | |
| 5,197,625 | A | 3/1993 | Mullaney | |
| 5,348,219 | A | 9/1994 | Brintazzoli | |
| D361,262 | S | 8/1995 | Lusker | |
| 5,465,834 | A | 11/1995 | Sieber et al. | |
| 5,505,370 | A | 4/1996 | Brown et al. | |
| 5,505,373 | A | 4/1996 | von Stillfried | |
| 5,540,330 | A | 7/1996 | Lo Duca | |
| 5,607,058 | A | 3/1997 | Huesman et al. | |
| D390,330 | S | 2/1998 | Skaya | |
| 5,725,620 | A | 3/1998 | Perea et al. | |
| 5,845,424 | A | 12/1998 | Mitchell | |
| 5,918,799 | A | 7/1999 | Walsh | |
| 5,927,498 | A | 7/1999 | Saam | |
| D425,413 | S | 5/2000 | Heeley et al. | |
| 6,079,563 | A | 6/2000 | Katchmazenski | |
| 6,116,499 | A | 9/2000 | Hengami | |
| 6,227,440 | B1 | 5/2001 | Hart | |
| 6,273,332 | B1 | 8/2001 | Hengami | |
| 6,360,942 | B2 | 3/2002 | Hengami | |
| D455,455 | S | 4/2002 | Katsuyama | |
| 6,393,707 | B1 | 5/2002 | Maffei | |
| 6,394,275 | B1 | 5/2002 | Paliotta et al. | |
| 6,435,402 | B1 | 8/2002 | Hengami | |
| 6,474,040 | B1 | 11/2002 | Ours et al. | |
| 6,637,646 | B1 | 10/2003 | Muise et al. | |
| 6,691,869 | B2 | 2/2004 | Knaack et al. | |
| 6,733,555 | B1 | 5/2004 | Wilder | |
| 6,889,892 | B2 | 5/2005 | Walsh et al. | |
| D508,850 | S | 8/2005 | Ghini et al. | |
| 6,945,449 | B2 | 9/2005 | Hengami | |
| 6,971,524 | B1 | 12/2005 | Voswinkel | |
| 7,040,528 | B2 | 5/2006 | Hengami | |
| 7,097,043 | B2 | 8/2006 | Hsu | |
| 7,156,286 | B2 | 1/2007 | Hengami | |
| D551,967 | S | 10/2007 | Hengami | |
| D552,987 | S | 10/2007 | Magnusson | |
| 7,337,904 | B2 | 3/2008 | Hengami | |
| D580,754 | S | 11/2008 | An | |
| 7,494,044 | B2 | 2/2009 | Walsh et al. | |
| 7,503,475 | B2 | 3/2009 | McGowan | |
| D594,743 | S | 6/2009 | Lukka | |
| 7,661,578 | B2 | 2/2010 | Li | |
| 7,743,973 | B2 | 6/2010 | Hegami | |
| 7,992,764 | B2 | 8/2011 | Magnusson | |
| 8,261,964 | B2 | 9/2012 | Raupach et al. | |
| 8,499,999 | B2 | 8/2013 | Sieber et al. | |
| 8,739,969 | B2 | 6/2014 | Schuld | |
| 8,800,855 | B2 | 8/2014 | Fitzwater | |
| 8,844,797 | B2 | 9/2014 | Smith | |
| 9,085,386 | B2 | 7/2015 | Hengami | |
| 9,394,066 | B2 | 7/2016 | Hengami | |
| 9,394,076 | B2 | 7/2016 | Hengami | |
| 9,561,878 | B2 | 2/2017 | Lee | |
| 9,643,749 | B2 | 5/2017 | Wagner | |
| 10,086,990 | B2 | 10/2018 | Hengami | |
| 10,899,496 | B2 | 1/2021 | Hengami | |
| 11,066,209 | B2 | 7/2021 | Hengami | |
| 11,111,052 | B2 | 9/2021 | Hengami | |
| 11,180,281 | B2 | 11/2021 | Hengami | |
| 11,186,405 | B2 | 11/2021 | Hengami | |
| 11,220,369 | B2 | 1/2022 | Hengami | |
| 11,292,634 | B2 | 4/2022 | Hengami | |
| 2003/0217944 | A1 | 11/2003 | Belloli et al. | |
| 2003/0230498 | A1 | 12/2003 | Maute | |
| 2004/0065723 | A1 * | 4/2004 | Hengami | B65D 5/723 229/125.12 |
| 2005/0061864 | A1 | 3/2005 | Lee | |
| 2005/0067476 | A1 | 3/2005 | Hengami | |
| 2005/0098616 | A1 | 5/2005 | Chang | |
| 2005/0211754 | A1 | 9/2005 | Fulcher | |
| 2006/0124709 | A1 | 6/2006 | Hengami | |
| 2007/0251848 | A1 | 11/2007 | Hengami | |
| 2007/0261990 | A1 | 11/2007 | Weston | |
| 2008/0128478 | A1 | 6/2008 | Quadrelli | |
| 2008/0128480 | A1 * | 6/2008 | Hegami | B65D 5/723 229/131.1 |
| 2011/0057024 | A1 | 3/2011 | Sieber et al. | |
| 2011/0062175 | A1 | 3/2011 | Nakamura et al. | |
| 2011/0111938 | A1 | 5/2011 | Smith | |
| 2011/0162997 | A1 | 7/2011 | Robbins et al. | |
| 2011/0168767 | A1 | 7/2011 | Hengami | |
| 2013/0075462 | A1 | 3/2013 | Jones et al. | |
| 2015/0321788 | A1 | 11/2015 | Hengami | |
| 2016/0297589 | A1 | 10/2016 | You et al. | |
| 2019/0144156 | A1 * | 5/2019 | Hengami | B65D 5/48014 229/120.18 |

FOREIGN PATENT DOCUMENTS

| | | |
|---|---|---|
| EP | 0642977 B1 | 4/1996 |
| EP | 0732269 A1 | 9/1996 |
| EP | 0761550 A1 | 3/1997 |
| FR | 2799743 | 4/2001 |
| JP | 07223634 | 8/1995 |

OTHER PUBLICATIONS http://samanthaleewaiker.blogspot.in/2012/12/ornament-box-tutorial.html / Samantha Walker's Imaginary World Ornamental Box Tutorial; retrieved Aug. 2, 2018: 1 page.

https://www.pinterest.se/pin/156922986722138 67/?lp=true / / Corrugated Box with Internal insert #packaging; retrieved Aug. 2, 2018; 1 page.

https://www.pinterest.nz/pin/6848856808218 / / Pinterest; retrieved Aug. 2, 2018; 1 page.

(56) References Cited

OTHER PUBLICATIONS

PCT/US2022/34764. International Search Report and Written Opinion dated Oct. 19, 2022.

* cited by examiner

DUAL COMPARTMENT DISPENSING BOX WITH LATERAL SLIDE OPENINGS

CROSS-REFERENCE TO RELATED APPLICATIONS

This application is a continuation of U.S. patent application Ser. No. 16/576,729, entitled "Dual Compartment Dispensing Box with Lateral Slide Openings," filed Sep. 19, 2019, which claims priority to provisional application No. 62/733,557 filed Sep. 19, 2018 entitled "Dual Compartment Dispensing Box With Lateral Slide Openings," the contents of which are incorporated by reference herein in their entirety.

BACKGROUND

Major food and candy manufacturers employ high-speed packaging automation systems to form, fill and seal flat box blanks (FBB) to produce packages filled with solid pourable product in mass volume. The majority of FBBs typically have the bottom end folded and sealed, then the boxes are filled with product such as mints, small candies or nuts prior to sealing the top end, finishing the manufacturing process. Fill and seal boxes often incorporate re-closable openings, which are favored by consumers, and are formed as part of the FBB itself.

One popular type of re-closable box known in the art is typically formed from a cardboard FBB capable of rapid folding, and which offers a re-closable, sliding opening incorporated into the unassembled FBB, and which is constructed during the folding process prior to sealing. Up to now, such boxes have been limited in that they include a convenient sliding re-closable opening, but have only one such sliding opening, and thus can contain only one product.

While closable boxes are known to have slide openings, including slides that move up and down at the top of the box and include a catch mechanism to prevent the slide from dislodging, such boxes have certain drawbacks. For example, manipulating such a box to facilitate movement of the slide with a single hand is difficult because the slide moves away from the top of the box, and thus generally requires that a user utilize both hands to operate the slides. While using two hands to operate such a box, a user may not engage in multiple tasks, and thus opening, closing and pouring out contents of the box is inconvenient.

Therefore, there remains a need for a box having two compartments and that offers a convenient dual lateral slide opening for easily dispensing of a solid pourable or a similar product, wherein the box is easy to manufacture on a mass production scale using conventional high-speed packaging machines, and which is constructed in such a way that avoids any slide insertion step, but that incorporates multiple independently operable slide openings. There is further a need for such a box having these characteristics while also having the same appearance and handling characteristics as a conventional box, wherein the lateral slide flaps are operated by one hand and individually dispense the contents according to preference, and which is made from a single FBB.

SUMMARY

A package or box for separately dispensing different types of pourable product which may be made of a single cardboard blank having panels extending lengthwise, an outer front panel, a back panel, an inner front panel, a separator panel and a top panel, all connected together and folded to form a box which has a first compartment and a second compartment. The inner front panel may have a first opening and a second opening, a first slide and a second slide connected to the outer front panel but detachable. The slides are preferably foldably connected to side panels between the front and back panels of the box. The outer front panel is positioned to overlay the inner front panel such that the first and the second slides overlay a first opening and second opening in the inner front panel. Further, the top panel has corresponding openings and preferably is positioned to overlay and encapsulate the first and second slides. The slides are moveable laterally such that dispensing paths are formed through the substantially aligned openings in the top panel and the inner front panel.

DESCRIPTION

Figure 1:
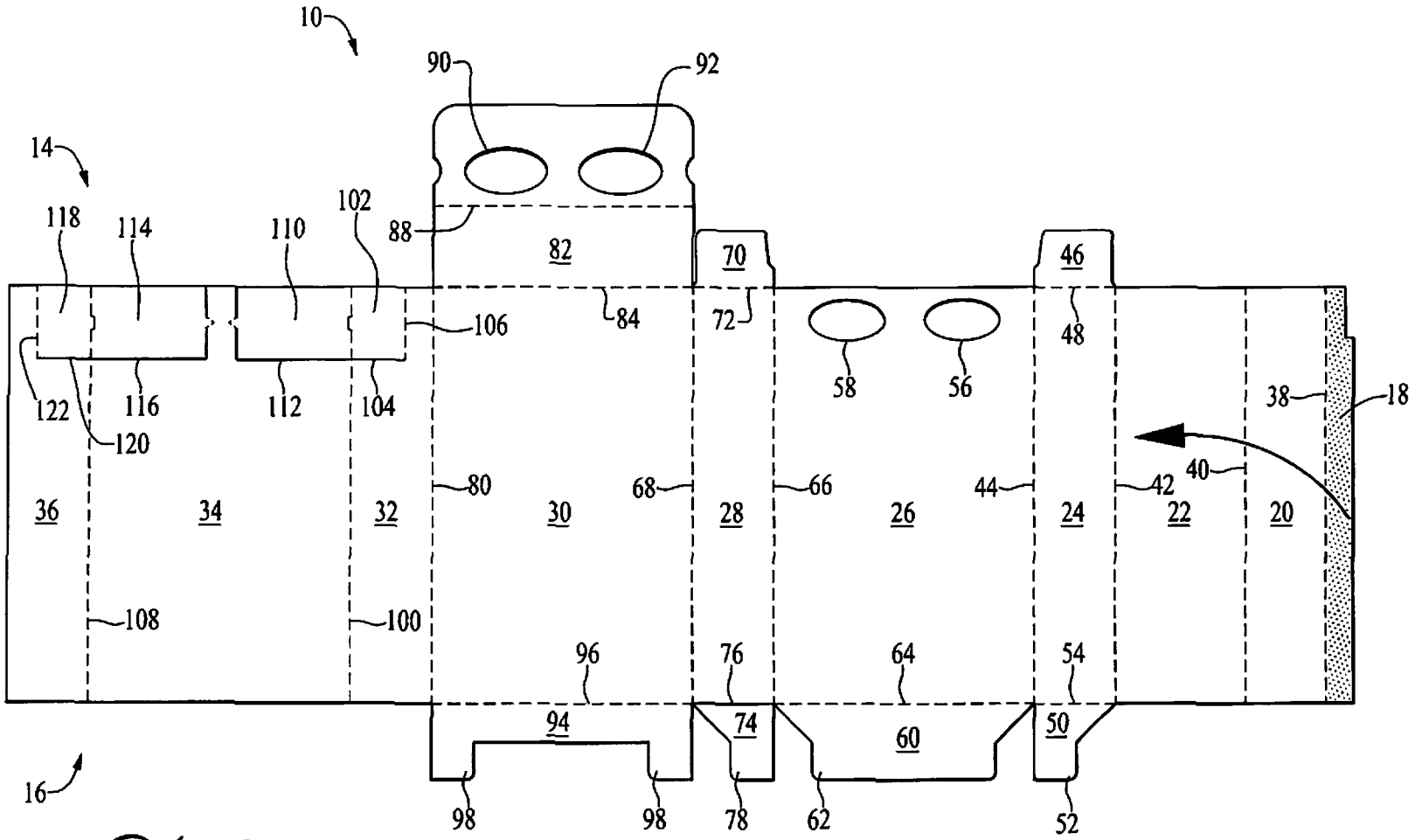
FIG. 1 is a flat pattern view of a cardboard blank which can be folded to form a dual compartment box with lateral slide openings.

As defined herein, an opening may refer to an aperture, an opening, a hole cut from a blank, or any variety of similar understanding. FIG. 1 illustrates a die cut paper or cardboard blank 10 that may be used to form a box 12 (FIGS. 4 and 5) with re-closable openings. The cardboard blank 10 has a top end 14 and a bottom end 16 and is configured for folding such that the box 12 has a first compartment 124 (FIGS. 2-5) and a second compartment 126 (FIGS. 3-5), preferably adjacent one another. Major folding portions of the cardboard blank include an inner tab 18, separator panel 20, first container front panel 22, front minor side 24, inner front panel 26, third minor side 28, back panel 30, first side panel 32, outer front panel 34, and second side panel 36, all arranged in series and preferably in a foldable relationship to one another.

Still referring to FIG. 1, inner tab 18 is foldably connected to the separator panel 20 along an inner tab fold line 38. The separator panel 20 is foldably connected to the first minor side 22 along a dual compartment separator panel fold line 40, the first compartment front panel 22 is foldably connected to the front minor side 24 along a first compartment front panel fold line 42, and the front minor side 24 is foldably connected to the inner front panel 26 along a first minor side fold line 44. The front minor side 24 includes a first top tab 46 foldably connected to the top end 14 of the front minor side 24 along a first top tab fold line 48, and a first bottom tab 50 is foldably connected to the front minor side 24 along the bottom end 16 of the front minor side 24 along a first bottom tab fold line 54. The first bottom tab 50 includes a first bottom notch tab 52 opposite the first bottom tab fold line 54.

The inner front panel 26 is foldably connected to the third minor side 28 along a dual compartment front panel fold line 66. The inner front panel 26 includes a first opening 56 and second opening 58 by which a user may access the first compartment 124 and second compartment 126, respectively, when the box 12 is completed. The inner front panel 26 also includes a second bottom tab 60 foldably connected along the second bottom tab fold line 64 which includes a second bottom notch tab 62 located on the second bottom tab 60 opposite the second bottom tab fold line 64.

The third minor side 28 is foldably connected to the back panel 30 along the second minor side fold line 68 and includes a second top tab 70 foldably connected to the third minor side 28 along a second top tab fold line 72. The third minor side 28 also includes a third bottom tab 74 foldably connected to the third minor side 28 along a third bottom tab fold line 76, and a third bottom notch tab 78. The back panel 30 is foldably connected to the first side panel 32 along a back panel fold line 80 and includes a lid 82 foldably connected to the back panel 30 along a dual compartment lid fold line 84. The lid 82 has a dual compartment front flap fold line 88, and includes a third opening 90 and a fourth opening 92. A fourth bottom tab 94 is foldably connected to the back panel 30 along a fourth bottom tab fold line 96 and includes two fourth bottom tab appendages 98 shaped such that the fourth bottom tab 94 interfaces complimentary to the second bottom tab 60 and the second bottom notch tab 62.

Still referring to FIG. 1, the first side panel 32 is foldably connected to the outer front panel 34 along a third minor side fold line 100 and includes a first compartment side flap 102 defined about a first cut line 104 parallel to the top end 14 of the first side panel 32, and a first compartment fold line 106 perpendicular to the top end 14 of the first side panel 32 such that the first cut line 104 and first compartment fold line 106 form a substantial right angle with each another. The outer front panel 34 is foldably connected to the second side panel 36 along a front panel fold line 108 and includes a first slide 110 defined by a second cut line 112, and a second slide 114 defined by a third cut line 116. In a preferred embodiment, the first slide 110 and second slide 114 are located at the top end 14 of the outer front panel 34 and laterally oppose each other.

The second side panel 36 includes a second compartment side flap 118 defined about a fourth cut line 120 parallel to the top end 14 of the second side panel 36, and a second compartment fold line 122 perpendicular to the top end 14 of the second side panel 36 such that the fourth cut line 120 and second compartment fold line 122 form a substantial right angle with each another. As shown by the arrow in FIG. 1, a first step in assembling the box 12 from the cardboard blank 10 may be folding the inner tab 18, separator panel 20, first container front panel 22, and front minor side 24 all at substantially right angles such that the first compartment 124 is formed.

Figure 2:
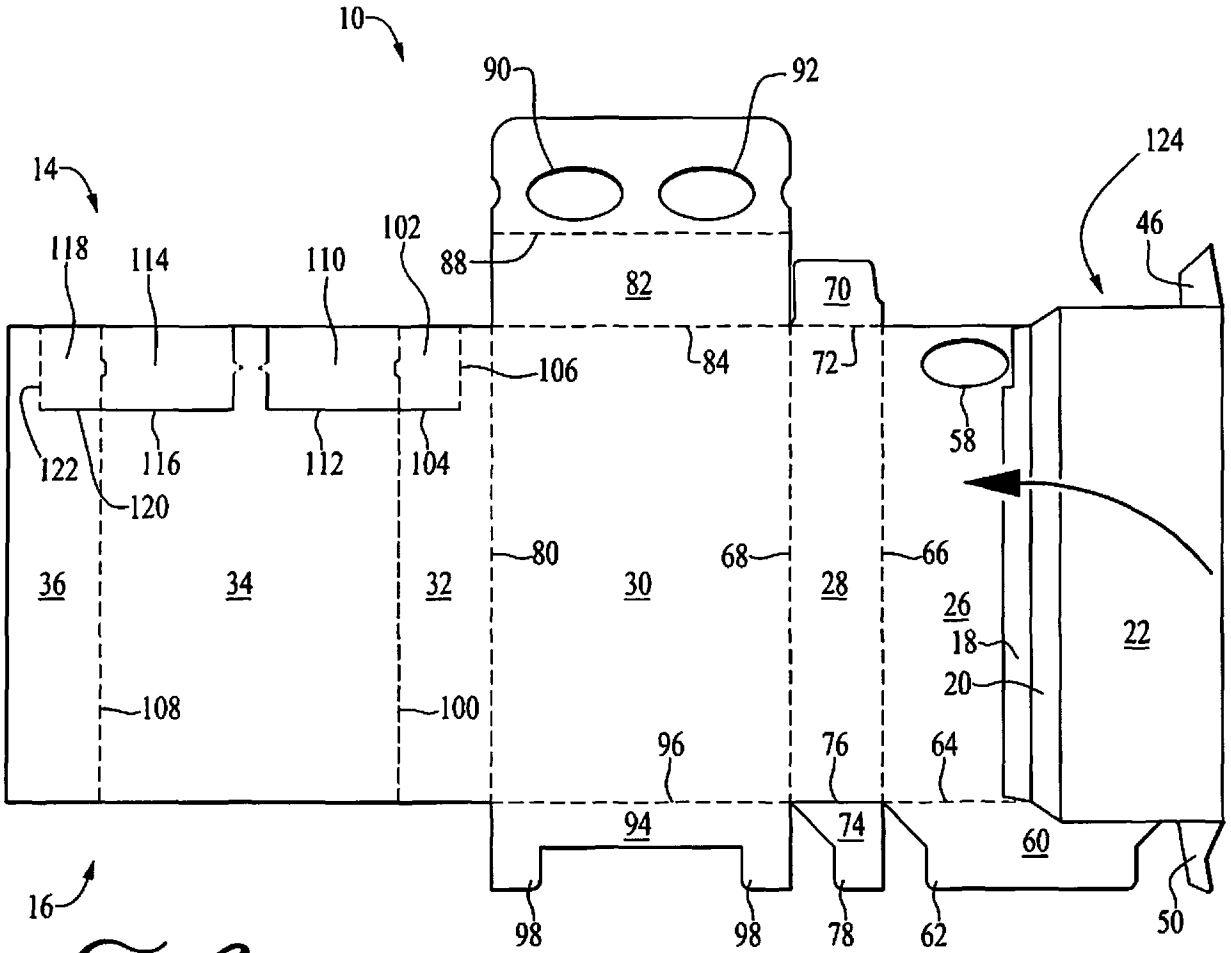
FIG. 2 is a perspective view of the cardboard blank showing a first assembly step toward forming the dual compartment box with lateral slide openings.

Referring to FIG. 2, the first compartment 124 partially covers the inner front panel 26 with the inner tab 18 preferably reverse folded to extend away from the first compartment 124 and adhesively adhered or otherwise affixed to the inner front panel 26. As shown by the arrow in FIG. 2, a second assembly step may be folding the inner front panel 26 (including the first compartment 124 formed by the separator panel 20, first container front panel 22 and front minor side 24 over the back panel 30.

Figure 3:
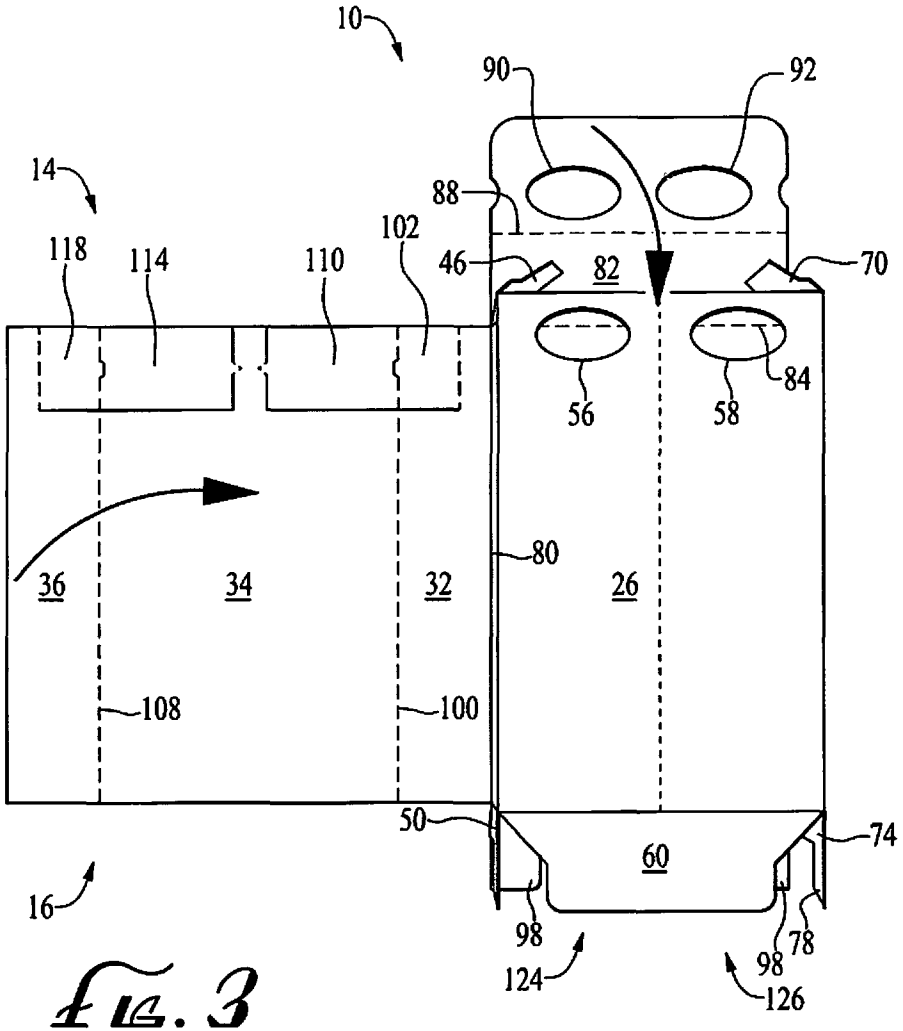
FIG. 3 is a perspective view of the cardboard blank showing a second assembly step toward forming the dual compartment box with lateral slide openings.

Referring now to FIG. 3 the second compartment 126 is formed by folding the inner front panel 26 (including the first compartment 124) over the back panel 30. In this configuration, the third minor side 28 is folded along the dual compartment front panel fold line 66 and second minor side fold line 68 such that the third minor side 28 is at a right angle respective to the inner front panel 26 and back panel 30. The underlying first compartment 124 and second compartment 126 are indicated by a vertical broken line as shown on the inner front panel 26. As shown by the horizontal arrow, a third assembly step of the box 12 may be folding the outer front panel 34 over the inner front panel 26. In this configuration, the first side panel 32 and second side panel 36 are at substantial right angles respective to the outer front panel 34 along the third minor side fold line 100 and front panel fold line 108, respectively. With the exception of the second compartment side flap 118, the second side panel 36 may thereafter be adhesively adhered or otherwise affixed to the third minor side 28. Additionally, with the exception of the first compartment side flap 102, the first side panel 32 may be adhesively adhered or otherwise affixed to the front minor side 24. In this configuration, the second slide 114 and the first slide 110 are folded over the second opening 58 and first opening 56

As shown by the top arrow in FIG. 3, the top panel or lid 82 may be folded over the outer front panel 34 and is preferably adhesively adhered or otherwise affixed thereto. Preferably, upon folding down the lid 82, the lid 82 and back panel 30 are at substantial right angles respective to the back panel 30. The lid 82 constitutes the top portion of the box and the front flap having the apertures. Preferably, the lid 82 is folded over the inner front panel 26 such that the first opening 56 substantially aligns with the third opening 90 with the first slide 110 positioned therebetween, and the second opening 58 substantially aligns with the fourth opening 92 with second slide 114 positioned therebetween. In various embodiments, the first opening 56 and third opening 90, and the second opening 58 and fourth opening 92 may be of differing sizes to facilitate dispensing of a pourable product.

Figure 4:
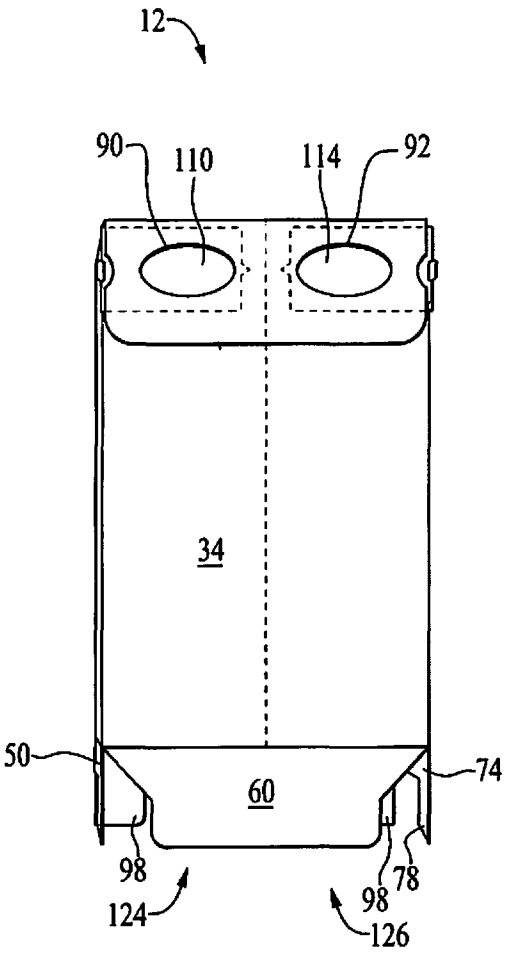
FIG. 4 is a perspective view of the dual compartment box with lateral slide openings, with the bottom flaps open.

As illustrated in FIG. 4, the outer front panel 34 has been folded over the inner front panel 26 and the lid 82 has been folded over the outer front panel 34, forming the box 12 with the bottom yet to be assembled. The first slide 110 is represented by broken lines adjacent the top end 14 of the box 12 and is positioned atop the first opening 56 (FIG. 3), and the third opening 90 is positioned atop the first slide 110. Similarly, the second slide 114 is represented by broken lines adjacent the top end 14 of the box 12 and is positioned atop the second opening 58 (FIG. 3), with the fourth opening 92 positioned atop the second slide 114. As represented by vertical broken lines across the outer front panel 34, the underlying first compartment 124 and second compartment 126 are positioned beneath the outer front panel 34.

Figure 5:
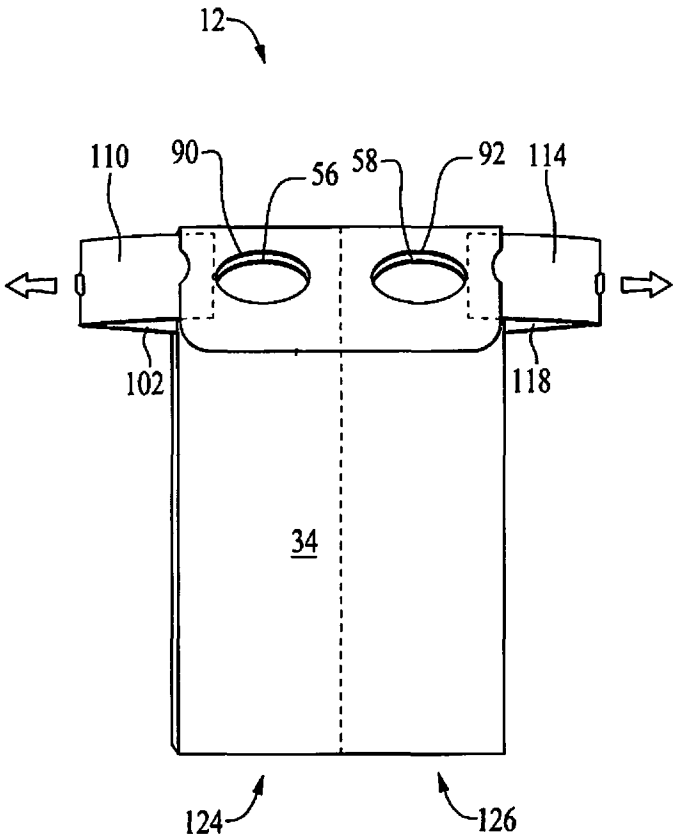
FIG. 5 is a perspective view of a fully assembled dual compartment box, showing two lateral slides opened for accessing each of the two compartments.

FIG. 5 illustrates the box 12 in complete assembly. Once the box 12 has been filled with a pourable product, box 12 assembly continues with the fourth bottom tab 94 folded inward, followed by the third bottom tab 74 and first bottom tab 50. To complete assembly, the second bottom tab 60 is folded over the first bottom tab notch 52 and third bottom tab notch 78, and inserted within the interior of the box 12 by way of space created between the fourth bottom tab appendages 98.

Still referring to FIG. 5, the first compartment side flap 102 and first slide 110 are extended laterally to an outward position from the box 12 so that the first opening 56 and third opening 90 are unobstructed, creating access to the first compartment 124, and thus allowing a solid pourable product to be dispensed from first compartment 124. The first slide 110 is preferably sized such that it does not become disengaged from the lid 82 upon lateral extension away from the box 12.

Still referring to FIG. 5, the second compartment side flap 118 and second slide 114 are extended laterally to an outward position from the box 12 so that the second opening 58 and fourth opening 92 are unobstructed, creating access to second compartment 126, and thus allowing a solid pourable product to be dispensed from the second compartment 126. The second slide 114 is preferably sized such that it does not become disengaged from the lid 82 upon lateral extension away from the box 12.

While particular forms of the invention have been illustrated and described, it will also be apparent to those skilled in the art that various modifications can be made without departing from the spirit and scope of the invention. Accordingly, it is not intended that the invention be limited except by the appended claims.

Insofar as the description above and the accompanying drawing disclose any additional subject matter that is not within the scope of the claims below, the inventions are not dedicated to the public and the right to file one or more applications to claim such additional inventions is reserved.

What is claimed is:

1. A package for separately dispensing different types of pourable product, the package comprising:

a) a cardboard blank having:

i) an outer front panel having a first opening and a second opening;

ii) a back panel;

iii) an inner front panel;

iv) a top panel having a third opening and a fourth opening; and v) a first slide and a second slide;

wherein the panels extend longitudinally and are foldably connected together to form a box having a first compartment and a second compartment;

wherein the outer front panel is positioned to overlay the inner front panel such that the first slide and the second slide overlay the first opening and second opening in the inner front panel; and wherein the third opening and the fourth opening are positioned to overlay and encapsulate the slides, and the first slide and the second slide are moveable laterally such that a first dispensing path is formed through the third opening in the top panel and the first opening in the inner front panel, and a second dispensing path is formed through the fourth opening in the top panel and the second opening in the inner front panel.

2. The package of claim 1 wherein the first slide is moveable laterally in one direction to close the first dispensing path and the second slide is moveable laterally in an opposite second direction to close the second dispensing path.

3. The package of claim 1 wherein blank comprises a separator panel and the first slide and the second slide are moveable laterally in an outboard direction away from the separator panel between the first compartment and the second compartment.

4. The package of claim 1 further comprising a bottom flap foldably connected to the single cardboard blank for closing a bottom portion of the box.

5. The package of claim 1 further comprising a first minor side and a second minor side each foldably connected to the outer front panel.

6. The package of claim 5 wherein the first slide is foldably connected to the first minor side, and the second slide is foldably connected to the second minor side.

7. A dual compartment box for conveniently dispensing two different pourable products, the box comprising:

a) a single paper blank having:

i) an outer front panel;

ii) a back panel;

iii) an inner front panel having a first aperture and a second aperture;

iv) a separator panel;

v) a top panel having a third aperture and a fourth aperture, the top panel overlays the first and second slides and the inner front panel such that the first aperture and the third aperture substantially align and the second aperture and the fourth aperture substantially align; and vi) a first slide and a second slide positioned between the top panel and the inner front panel, the first slide being moveable laterally to form a first dispensing path, and second slide being moveable laterally to form a second dispensing path;

wherein the panels are foldably connected to form a box having a first compartment and a second compartment.

8. The box of claim 7, wherein the blank has a first side panel and a second side panel, and the first slide is foldably connected to the first side panel and the second slide is foldably connected to the second side panel.

9. The box of claim 7, wherein the first slide is moveable laterally in one direction to close the first dispensing path and the second slide is moveable laterally in an opposite second direction to close the second dispensing path.

10. The box of claim 7, wherein the first slide and the second slide are moveable laterally in an outboard direction away from the separator panel between the first compartment and the second compartment.

11. The box of claim 7 further comprising a bottom flap foldably connected to the blank for closing a bottom portion of the box.

* * * * *